United States Patent [19]

Lee

[11] Patent Number: 4,970,521

[45] Date of Patent: Nov. 13, 1990

[54] PHASED ARRAY ANTENNA ALIGNMENT METHOD

[75] Inventor: Kang S. Lee, Northport, N.Y.

[73] Assignee: Unisys Corporation, Blue Bell, Pa.

[21] Appl. No.: 423,296

[22] Filed: Oct. 18, 1989

[51] Int. Cl.[5] ..... H01Q 3/00

[52] U.S. Cl. ..... 342/360; 343/703

[58] Field of Search ..... 342/360; 343/703

[56] References Cited

U.S. PATENT DOCUMENTS 4,453,164 6/1984 Patton ..... 343/360

*Primary Examiner*—Gregory C. Issing

*Attorney, Agent, or Firm*—Seymour Levine; Albert B. Cooper

[57] ABSTRACT

A method for obtaining excitation errors of elements in an array antenna increases the element unit cell area in the aperture plane by reducing the size of the fundamental period in spectrum space. An element unit cell in the aperture plane is increased by appropriately selecting rows of elements to establish row sets. A polarity of near field measurements are made with the phase shift applied to the elements of one row set for each measurement and the spectrum for each row set is determined from the data of the plurality of measurements. This spectra is then utilized to determine the element excitation coefficients.

7 Claims, 4 Drawing Sheets

$$(1a)\quad s(u,v)=\sum_{n,m} a_{nm}\, e^{j\frac{2\pi}{\lambda}(un\,D_x+vm\,D_y)}$$

$$(1b)\quad a_{nm}=\frac{D_xD_y}{\lambda^2}\int_{\frac{-\lambda}{2D_y}}^{\frac{\lambda}{2D_y}}\int_{\frac{-\lambda}{2D_x}}^{\frac{\lambda}{2D_x}}\frac{f(u,v)}{e(u,v)}\,e^{-j\frac{2\pi}{\lambda}(unD_x+vmD_y)}\,du\,dv$$

$$(2a)\quad \frac{1}{e(u,v)}\begin{bmatrix} f_1(u,v)\\ f_2(u,v)\\ f_3(u,v)\end{bmatrix}=\begin{bmatrix} e^{j\phi} & 1 & 1\\ 1 & e^{j\phi} & 1\\ 1 & 1 & e^{j\phi}\end{bmatrix}\begin{bmatrix} s_1(u,v)\\ s_2(u,v)\\ s_3(u,v)\end{bmatrix}$$

$$(2b)\quad \begin{bmatrix} s_1(u,v)\\ s_2(u,v)\\ s_3(u,v)\end{bmatrix}=\frac{1}{\Delta}\begin{bmatrix} e^{j2\phi}-1 & 1-e^{j\phi} & 1-e^{j\phi}\\ 1-e^{j\phi} & e^{j2\phi}-1 & 1-e^{j\phi}\\ 1-e^{j\phi} & 1-e^{j\phi} & e^{j2\phi}-1\end{bmatrix}\begin{bmatrix} \frac{f_1(u,v)}{e(u,v)}\\ \frac{f_2(u,v)}{e(u,v)}\\ \frac{f_3(u,v)}{e(u,v)}\end{bmatrix}$$

$$\Delta=e^{j3\phi}-3e^{j\phi}+2$$

$$3\quad f(u,v)=e(u,v)\left[s_1(u,v)+s_2(u,v)+s_3(u,v)\right]$$

FIG. 8.

PHASED ARRAY ANTENNA ALIGNMENT METHOD

BACKGROUND OF THE INVENTION

1. Field of the Invention

The invention pertains to the field of antenna alignment, and more particular to the alignment of an antenna with near field measurements.

2. Description of the Prior Art

Procedures for localizing the defective elements of the phased array antenna using near field measurements exist in the prior art. The underlining concept in all these methods is the utilization of the Fourier and inverse Fourier transform relationships between the peak element excitations and the array spectrum of the antenna (array factor). The array spectrum of a planar phased array antenna when multiplied by the element pattern determines the far field pattern of the array antenna. Since the element locations of the phased array antenna repeat with the same unit cell lattice in the aperture plane, the array spectrum is periodic in the spectrum space. Consequently, the whole array spectrum can be constructed with the spectrum of the fundamental period. Once the spectrum of the fundamental period in the spectrum space is known, the inverse Fourier transform of the array spectrum uniquely specifies the element excitations, thereby providing information for correcting individual element excitation errors and establish the antenna alignment. With these procedures, a full spectrum of the fundamental period cannot be acquired because the spectrum space is divided into visible and invisible regions, the visible region being within a unit circle defined by $u^2+v^2=1$, centered at the center of the fundamental period, where u and v are propagating directions $\sin\theta\cos\phi$ and $\sin\theta\sin\phi$, respectively.

Many phased array antennas in which grating lobes are suppressed have element spacings that establish a spectrum space that extends beyond the visible region defined by the unit circle. The array spectrum of the fundamental period within the unit circle represents a propagating wave while the array spectrum of the fundamental period outside the unit circle represents an evanescent wave that decays exponentially as the distance from the antenna aperture increases. This evanescent wave cannot be directly measured. The visible array spectrum; however, can be determied by dividing the far field pattern by the element pattern. For the purpose of antenna alignment, the far field pattern must be specified both in amplitude and phase. Such a far field pattern can be provided with measurements in the near field of the antenna and extrapolating the measured data to the far field. Near field measurements rather than far field measurements are emphasized in an antenna alignment when the need exists for both the amplitude and phase characteristics of the far field pattern. The near field measurements are better suited for this purpose because the phase of the far field pattern may easily be referenced to the center of the antenna aperture.

Basic to the alignment procedure with near field measurements is access to the invisible spectrum of the fundamental period in the spectrum space. This problem arises whenever the fundamental period is not wholly within the visible space. Such a problem exists for wide angle scanning phased antennas. In these antennas, the elements are densely located in the aperture plane to prevent grating lobes from appearing in the visible space over an entire scan range. As the unit cell's size decreases, the area of the fundamental period in spectrum space increases, increasing the difficulty in obtaining the invisible spectrum. Because of this difficulty, some alignment methods of the prior art simply ignore the invisible spectrum and determine the element excitations applying the inverse Fourier transform to the visible spectrum only. Such an exclusion results in element excitation retrieving errors, which cannot be completely removed during the antenna alignment procedure. Errors caused by these prior art methods may be greater than those resulting from the truncation of the invisible spectrum when the far field pattern is determined by the Fourier transform of the aperture function, because the array spectrum close to the unit circle, even though it is visible, cannot be obtained accurately. To obtain the visible array spectrum, the far field pattern must be divided by the element pattern. It is not realistic to expect the element pattern in both amplitude and phase to be known accurately in the neighborhood of the unit circle since the amplitude at the boundary of the circle is zero. Consequently, the region of the spectrum space in which the array spectrum can be well defined is smaller than the visible space.

The above shortcomings of the alignment methods are overcome in the prior art by a spectrum merge technique disclosed in U.S. Pat. No. 4,453,164. This technique capitalizes on the inherent beam steering capability of a phased array antenna. The main beam is steered to a plurality of different directions, generally four, to achieve a desired accuracy, and near field measurements are performed at each beam position. When the four beam positions are utilized, a quarter of the fundamental period is brought within the visible space for each measurement. These fractional fundamental periods are then combined to establish a full spectrum over the fundamental period. The inverse Fourier transform of the constructed spectrum is then performed to establish individual element excitations from which excitation errors are determined. This method, however, is time consuming and does not provide sufficient accuracy for all applications.

One cause of inaccuracy of the spectrum merge method is the discontinuities that exist at the quadrant boundaries. These discontinuities are established by the difference in phase shifter and near field data acquisition errors encountered in the four near field measurements. Such discontinuities result in retrieved element excitation errors. Since the discontinuities stretch from the main lobe through the side lobes, the far-out side lobes as well as the side lobes near the main beam, which generally must meet stringent performance specifications, are effected.

SUMMARY OF THE INVENTION

A method for aligning the phased array antenna in accordance with the present invention utilizes the fact that the fundamental period in the spectrum spaced decreases as the unit cell area in the aperture plane of a phased array antenna increases. Though actual physical unit cell size cannot be changed, an appropriate row or column phase excitation selection provides an apparent element unit cell increase, which in turn decreases the size of the fundamental period of the spectrum space to be within the visible space, thus permitting phased array alignment without encountering the difficult problems of acquiring the invisible spectrum and deriving an element pattern close to the unit circle.

In accordance with the invention, element rows or columns in the aperture plane are grouped into sets. In this manner, the size of the set element unit cell is increased relative to the original array unit cell in accordance with the number of rows or columns in a set. The number of rows or columns in the set are selected to establish a fundamental period in the spectrum space which is within the visible space wherein the element pattern is well defined. Appropriate phase excitations are applied to the sets to separate the over-all array spectrum into a plurality of spectra equal to the number of sets established. For each applied phase excitation, the near field of the test antenna is measured and the data processed to construct the far field pattern. Thus, far field patterns equal to the number of established sets are generated. These far field patterns, the element pattern, and the phase excitation are then utilized to calculate all the set spectra. The inverse Fourier transform of each set spectrum may then be taken to retrieve the excitations of the elements belonging to the row set, thereby determining the excitation errors.

BRIEF DESCRIPTION OF THE DRAWINGS

FIG. 8 is a list of equations useful for explaining the invention.

DESCRIPTION OF THE PREFERRED EMBODIMENTS

Figure 1:
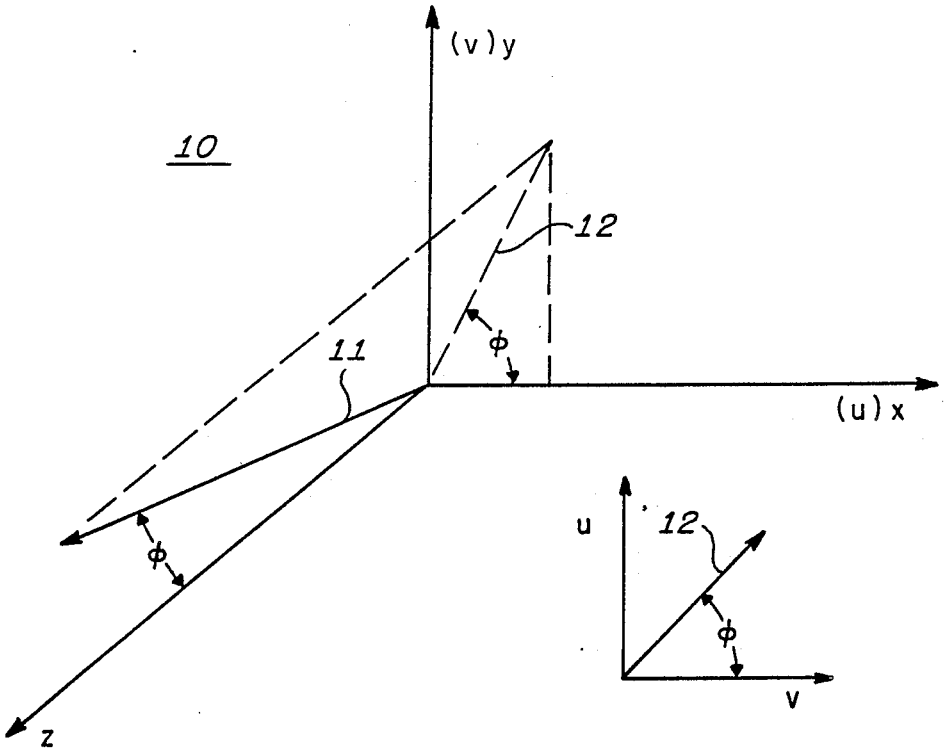
FIG. 1 is a representation of the coordinate system utilized in explaining the invention.

FIG. 1 is a representation of a unit vector 11 in three-dimensional space. The projection of this vector on the aperture plane of an array antenna, represented as the XY plane, is a vector 12 having a magnitude $\sin\theta$ and components $u=\sin\theta\cos\phi$ and $v=\sin\theta\sin\phi$. It is apparent that the relationship between u and v is $u^2+v^2=\sin^2\theta$. Since $\sin\theta=1$ for the transformation of the aperture plane to the u,v plane, the visible space in the u,v plane is defined by the equation $$u^2+v^2=1$$

Figure 2:
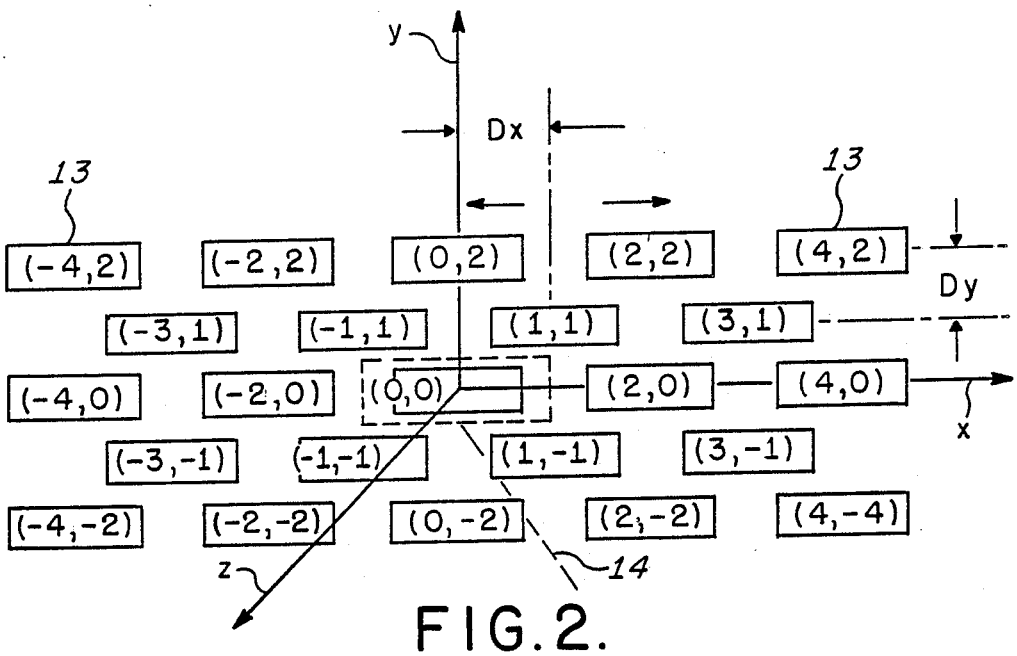
FIG. 2 is a representation of element location in the aperture plane, the X-Y plane, of an array antenna indicating thereon a unit cell area considered in the determination of element excitation errors by methods of the prior art.
Figure 3:
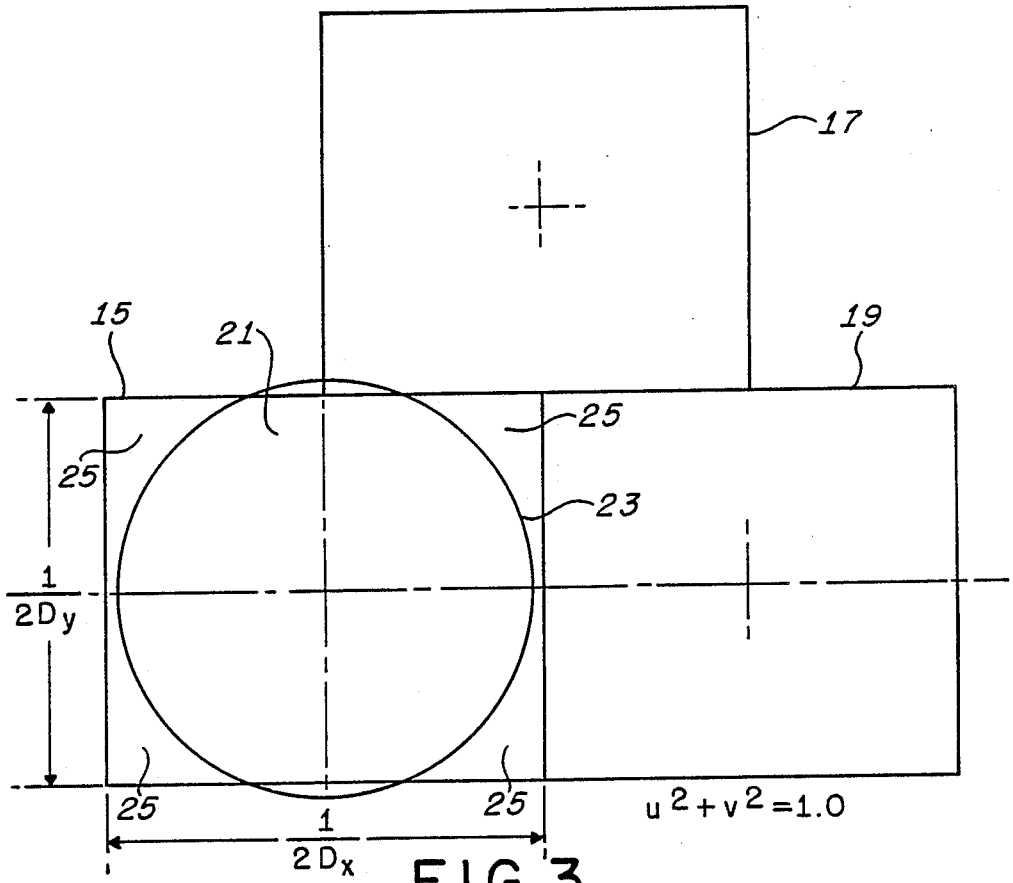
FIG. 3 is a representation of the fundamental period in the array spectrum space, indicating thereon, the visible and invisible space established by methods of the prior art.

FIG. 2 is a representation of a planar triangular array with center-to-center spacing along the X axis of $D_x$ and center-to-center spacing along the Y axis of $D_y$. The far field pattern f(u,v) for an array antenna is given by $$f(u,v)=e(u,v)\,s(u,v)$$

where e(u,v) is the pattern of the elements 13 and s(u,v) is the array spectrum (array factor). It is well known that the array spectrum s(u,v) and the element excitations $a_{nm}$ are Fourier transform pairs given by equations 1a and 1b in FIG. 8. As shown in FIG. 2, n and m are either both even or both odd. Consequently, from equation 1a, it can be readily seen that the array spectrum is periodic with a periodicity in u of $\lambda/2D_x$ and a periodicity in v of $\lambda/2D_y$. Shown in FIG. 3 is the visible region 21 for the fundamental period bounded by the circle 23 defined by the equation $u^2+v^2=1$. The element spacings assumed for FIG. 3 establish a significant invisible region for a period in spectrum space, referenced as 25 in the fundamental period.

Figure 4:
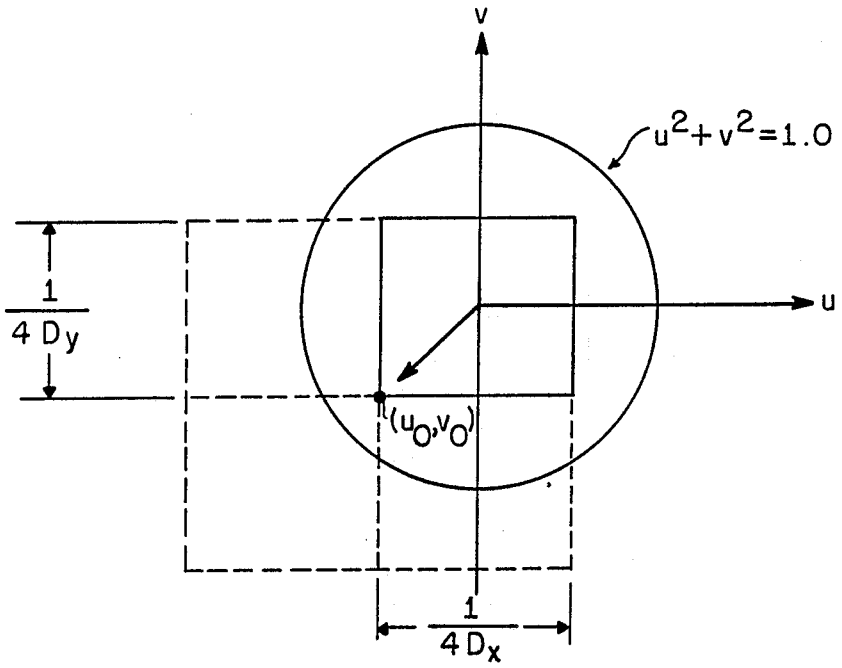
FIG. 4. PRIOR ART
FIG. 4 is a representation of the fundamental period provided by the spectrum merge technique.

As stated previously, a technique of the prior art is to steer the main beam to four different directions to bring successive quarters of the fundamental period within the visible region of spectrum space. This is illustrated in FIG. 4 for one of the beam positions $(u_0,v_0)$ which brings the upper righthand quarter and portions of the three other quarters within the visible space. Near field measurements are made for this beam position and repeated for three other beam positions. These partial array spectrum data are then merged to acquire a full spectrum over the fundamental period.

As indicated in FIG. 3, the size of a period in spectrum space is inversely proportional to the unit cell area in the aperture plane. Though the actual physical unit cell size cannot be changed, appropriate row or column phase excitations can achieve the effect of increasing the unit cell size. This in turn reduces the size of a spectral period in spectrum space and relocates the entire fundamental period within visible space. When the fundamental period is within the visible space, the phased array alignment may be accomplished without encountering the difficult problems of acquiring the invisible spectrum and deriving element patterns close to the unit circle.

Figure 6:
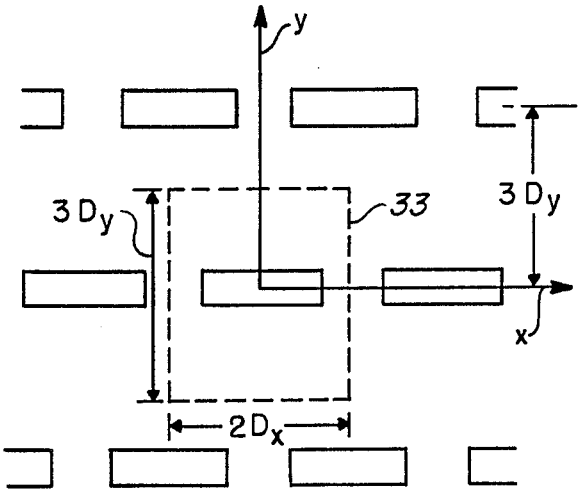
FIG. 6 is a representation of a unit cell of an array antenna in accordance with the invention.
Figure 7:
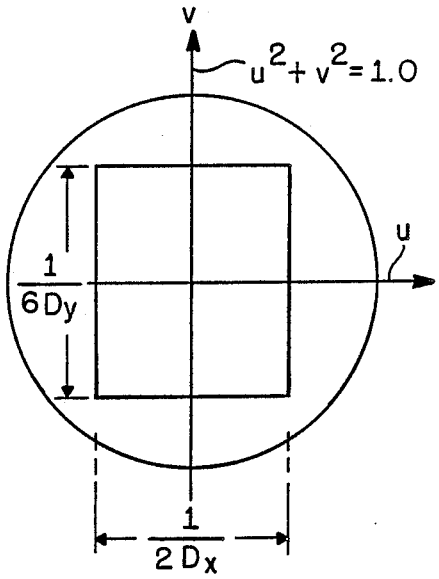
FIG. 7 is a representation of a fundamental period in accordance with the invention.
Figure 5:
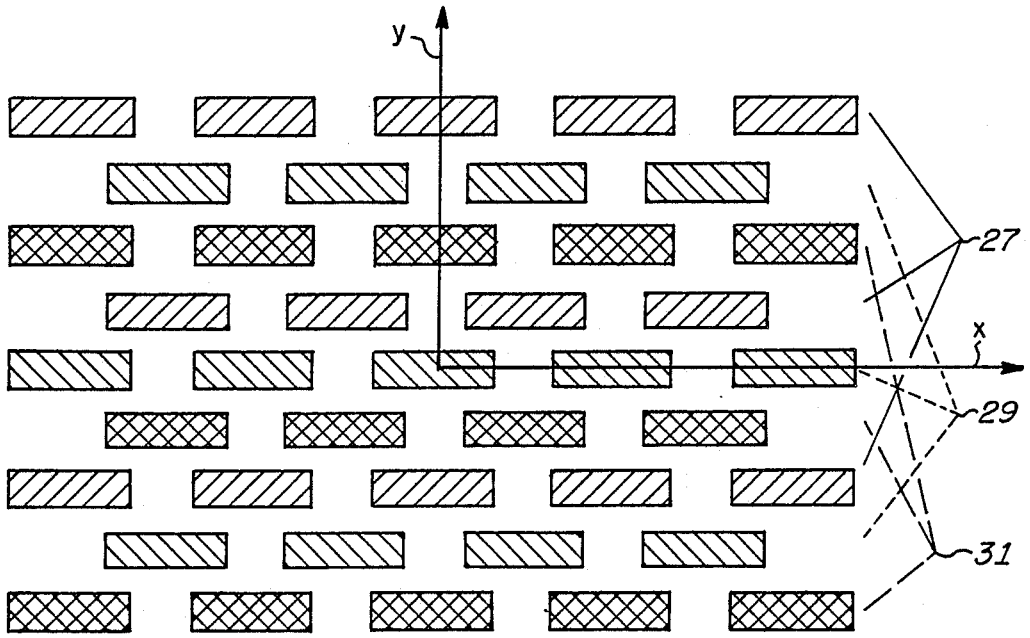
FIG. 5 is a representation of elements in an array antenna indicating thereon selected row sets in accordance with the invention.

An increase of an element unit cell may be achieved with the row element grouping indicated in FIG. 5. In this example, the nine rows of elements are divided into sets comprising three rows each; a first set 27 including the elements in every third row commencing with the first, a second set 29 including the elements in every third row commencing with the second row, and a third set 31 including the elements in every third row commencing with the third row. As shown in FIG. 6, the area of the unit cell 33 in the aperture plane for each row set is three times the area of a unit cell in the aperture plane for the composite array. This transforms the fundamental period in spectrum space to be well within the visible region where the element pattern is well-defined as shown in FIG. 7. Though an array of nine rows is illustrated for the example presented, wherein each row set contains three rows, it should be recognized that the method to be explained is not so limited. Arrays containing more than nine rows are measurable with this method. The method is applicable for any combination of two or more row sets, each containing at least two rows.

The concept of the reduced fundamental period in spectrum space may be exploited in a phased array alignment procedure by taking repeated near field measurements with appropriate phase shifts successively applied to the established row sets. The following table provides the phase shift applied to the row set excitations for each of the three measurements.

| PHASE EXCITATION | ROW SET 1 | 2 | 3 |
|---|---|---|---|
| 1 | $\phi$ | 0 | 0 |
| 2 | 0 | $\phi$ | 0 |
| 3 | 0 | 0 | $\phi$ |

In performing the first measurement, the phases of the elements in the first row set are shifted by a $\phi°$, where $\phi$ is a flexible angle optimally determined from such factors as array mutual couplings and impedance matching at the feed network terminations. No phase shift is introduced for the elements belonging to the second and third row sets. Similarly, the phase shift $\phi$ is applied only to row sets 2 and 3, respectively, when the second and third measurements are performed. Near field data obtained for each of the three measurements are processed to construct the far field pattern. The constructed far field pattern $f_1(u,v)$ is the superposition of the first row spectrum $s_1(u,v)$ multiplied by the phase factor $\exp(j\phi)$ with the second row set spectrum $s_2(u,v)$ and the third row set spectrum $s_3(u,v)$. In like manner, the far field patterns $f_2(u,v)$ and $f_3(u,v)$ for the second and third measurements are superpositions of the three row set spectrums $s_1(u,v)$, $s_2(u,v)$, and $s_3(u,v)$ with the phase shifts $\phi$ respectively applied to the second and third row sets. These measurements provide three independent equations represented by the matrix equation 2a, wherein e(u,v) is the element pattern, from which the row set spectra may be determined. As discussed previously, far field patterns are known only in the visible space and the area in the spectrum space where the element patterns are well-defined is even smaller. Such information limitations, however, on the element and far field patterns do not jeopardize the solution process for the row set spectra. As shown in FIG. 7, the fundamental periods of the row set spectra are substantially smaller than the visible space. Therefore, the element and far field patterns in these regions provide sufficient information for solving the fundamental period spectra of the row sets.

From the solution of equation 2a shown in equation 2b, it is apparent that the selection of 180° for the phase shifting angle $\phi$ provides a solution for the spectra of each of the row sets which is the sum of the far field patterns obtained from only two excitations. For this selection of row phase excitation, the element excitations of the summed row sets are cancelled, the net effect is the effective removal from the aperture of these row sets. The selection of 180° for the phase shifting angle $\phi$, however, establishes a high degree of mutual coupling between the array elements and causes high aperture reflection. It should be understood that the value of $\phi$ is flexible, but to obtain good results, this phase excitation should be appreciably less than 180°. It should also be recognized that the excitation of the elements in each row set may be obtained by taking the Fourier transform of that row set spectrum. An alternative method of obtaining the element excitations is to establish the far field pattern of the over-all array by summing the row set spectra and multiplying by the element pattern, as indicated by equation 3. The application of equation 1b then provides the element excitation.

A proper definition of the element excitation must be provided before element excitation errors may be determined. If the element pattern is considered to be the far field pattern of an isolated element, the retrieved excitation $a_{nm}$ is the coefficient of the dominant mode at the (n,m)th element in the aperture and the inverse transform shown in equation 1b is the transformation from the far field to the aperture plane. If e(u,v) is the far field pattern of an element in an array environment, the element excitation $a_{nm}$ is the complex coefficient of the mode in the waveguide of the (n,m)th element when the array is in the transmit mode. The latter definition is more useful for antenna alignment purposes, since the correction of the incident feed waveguide mode can be directly achieved once the actual element excitation is known. Correction of the aperture modes, however, is a more complicated task because of mutual coupling effects. These element aperture modes depend on both the incident mode of the waveguide feeding the element and the modes feeding the adjacent elements. It is therefore more convenient to interpret the element excitation $a_{nm}$ as the coefficient of the incident waveguide mode feeding (n,m)th element and to consider e(u,v) as the active element pattern. With these definitions $a_{nm}$ and e(u,v) the mutual coupling effects automatically taken into consideration within the framework of the problem formulation.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. A method for aligning an array antenna having a plurality of rows, each row containing a multiplicity of elements comprising the steps of:

establishing a multiplicity of row sets by providing m row sets with selections of every mth row commencing with a first row of said plurality of rows to establish a first row set, commencing with a second row of said plurality of rows to establish a second row set, and continuing to commencing with a mth row to establish a mth row set;

applying a predetermined phase shift to each element contained in one of said row sets;

performing near field measurements with said predetermined phase shift applied to said elements in said one of said plurality of row sets;

determining array spectra from said near field measurements; and utilizing said array spectra to establish excitation coefficients for all elements in said array antenna.

2. The method of claim 1 wherein the step of establishing a multiplicity of row sets includes providing waveguides as said elements in each of said rows.

3. A method in accordance with claim 2 wherein the step of determining array spectra includes the steps of:

determining far field patterns for each row set;

utilizing a mode in said waveguide to establish an element pattern; and determining element excitation coefficients from said row set far field patterns and said element pattern.

4. A method in accordance with claim 3 wherein the utilizing step includes the step of establishing said element pattern with a dominant mode in said waveguide.

5. The method of claim 1 wherein m in said providing step is equal to 3 set.

6. The method of claim 1 wherein said utilizing step includes the steps of:

determining an element pattern for said elements in said array antenna;

providing the sum of said array spectra; and multiplying said sum of said array spectra by said element pattern.

7. The method of claim 1 wherein said utilizing step includes the steps of:

providing a sum of said array spectra; and establishing excitation coefficients from said sum of said array spectra.

* * * * *